United States Patent [19]

Carey

[11] Patent Number: 4,702,056

[45] Date of Patent: Oct. 27, 1987

[54] SUBCEILING CONSTRUCTION

[75] Inventor: Bruce P. Carey, Saugus, Calif.

[73] Assignee: Integrated Ceilings, Inc., Los Angeles, Calif.

[21] Appl. No.: 911,972

[22] Filed: Sep. 25, 1986

[51] Int. Cl.[4] ..... E04B 5/52

[52] U.S. Cl. ..... 52/484; 52/488

[58] Field of Search ..... 52/484, 488, 311, 81, 52/664, 39; 362/148

[56] References Cited

U.S. PATENT DOCUMENTS

| | | | |
|---|---|---|---|
| D. 214,033 | 5/1969 | Starr | D25/1 |
| D. 228,493 | 10/1973 | Hrusch | D25/2 |
| D. 246,057 | 10/1977 | Maresca | D25/1 |
| 2,659,807 | 11/1953 | Wakefield | 52/484 X |
| 3,121,977 | 2/1964 | Bersudsky | 50/271 |
| 3,153,304 | 10/1964 | Evangelista | 50/101 |
| 3,185,833 | 5/1965 | Blitzer, Jr. | 240/9 |
| 3,303,338 | 2/1967 | Lyon | 240/9 |
| 3,503,166 | 3/1970 | Nakazawa et al. | 52/126 |
| 3,645,058 | 2/1972 | Jacobson et al. | 52/456 |
| 3,736,706 | 6/1973 | Stephenson | 52/28 |
| 3,768,224 | 10/1973 | Curtis | 52/668 |
| 4,189,888 | 2/1980 | Blitzer, Jr. | 52/484 |
| 4,413,457 | 11/1983 | Lahm et al. | 52/314 |
| 4,545,165 | 10/1985 | Carey et al. | 52/488 |

OTHER PUBLICATIONS

The Rigidlock Line, sales brochure from 1979, Sweets Catalog File.

Unidentified publication bearing heading "Glass Block Skylight Standard Installation Detail", pp. 21, 22.

Brochure—"Forms+ Surfaces Glass Block 8, 0, 10", 1983, copyright notice.

*Primary Examiner*—Carl D. Friedman

*Attorney, Agent, or Firm*—A. Lewis Worthem, Jr.; Robert H. Robinson; Kenneth E. Roberts

[57] ABSTRACT

A suspended grid subceiling and panel units therefor having the appearance of a continuous expanse of decorative light-transmitting block masonry. In a preferred embodiment, the panels units are assemblies of an opaque subgrid of rails and cross rails and translucent subpanels simulating the mortar lines and faces of glass block. The undersides of the grid main runners and cross runners are similar in shape to the subgrid rails and cross rails and have a surface finish matching the color and texture of the subgrid undersides.

17 Claims, 5 Drawing Figures

SUBCEILING CONSTRUCTION

BACKGROUND OF THE INVENTION

1. Field of the Invention

This invention relates to architectural subceilings, and more particularly to a suspended grid subceiling having the appearance of decorative, light-transmitting block masonry.

2. Description of the Prior Art

Masonry constructions of light-transmitting block are desirable architectural components. For example, glass block is valued as a building material for providing security, privacy, thermal and acoustic insulation, for directing or diffusing light, and for aesthetics. Glass block masonry is used in residential and commercial structures not only as walls, partitions and windows, but also in floors, ceilings, and skylights.

When glass block or similarly heavy light-transmitting block masonry is used in horizontally oriented applications such as in floors, ceilings, or skylights, it is especially necessary to provide support for the weight of the block and mortar. It is known, for example, to construct a glass block ceiling wherein the masonry is supported from below by a grating of cast iron. Such a grating is necessarily heavy, costly, difficult to install, and detracts from the appearance of the ceiling. Drawbacks such as these are likely to preclude the use of such materials in an interior ceiling, because the expense of installing and supporting the ceiling will outweigh the aesthetic and illumination advantages.

Thus, there is a heretofore unmet need for a ceiling construction having the appearance and optical properties of light-transmitting decorative block, yet which is lightweight, inexpensive, and easy to install.

SUMMARY OF THE INVENTION

The present invention meets the previously mentioned need by providing a subceiling construction comprising a suspended grid which supports subceiling panel units, each such panel unit comprising a subgrid and subpanels supported by the subgrid. Viewed from below, the subpanels have the appearance of decorative light-transmitting masonry block faces, the grid and subgrids have the appearance of mortar, and as a whole the subceiling has the appearance of a continuous expanse of decorative light-transmitting masonry.

According to a preferred embodiment of the invention, the subceiling grid comprises spaced, parallel main runners and spaced, parallel cross runners disposed transversely to the main runners intersecting at intervals therewith forming panel receiving grid openings. The panel units each comprise a subgrid of rails and cross rails forming a plurality of openings for receiving and supporting the subpanels.

The main runners, cross runners, rails and cross rails are preferably all formed with an inverted "T" cross-section. The subpanels are provided with peripheral flanges for resting atop the cross members of the rails and cross rails. The subgrids and subpanels together form panel units of a size and shape corresponding to the openings in the subceiling grid. The panel units are placed from above in the subceiling grid with the outermost portions of the subpanel flanges and the ends of the rails and cross rails resting atop the cross members of the main runners and cross runners.

Preferred materials for the components of the subceiling construction of this invention are molded, opaque plastic for the subgrid; molded, translucent plastic for the subpanels; and extruded aluminum or roll-form steel for the main runners and cross runners, the undersides of which are finished to match the surface finish of the subgrid. Use of materials such as these give the advantages of manufacturability, low cost, and light weight. The subpanels may be molded to simulate the appearance of many types of glass block designs such as "crushed ice" or ribbed patterns, or of non-glass patterns such as filigrees or grilles with translucent backings. Any desired color may be chosen.

The subceiling of the invention is most advantageously installed below a light source. Often, the light source will be artificial light such as fluorescent tubes, but it is also possible to install the subceiling below a skylight. The light diffusing properties of the subpanels serve to disguise the identity of the light source and to mask the otherwise unsightly appearance of the light source.

With the undersides of the grid main runners and cross runners and subgrid rails and cross rails being of similar color, texture, and width, it is difficult for an observer standing below to detect that the subceiling of the invention is constructed of preassembled modular panels of convenient size and easy removability. No special skills are required for installation other than those commonly possessed by persons skilled those in the installation of ordinary suspended grid subceilings.

DESCRIPTION OF THE PREFERRED EMBODIMENT

Figure 1:
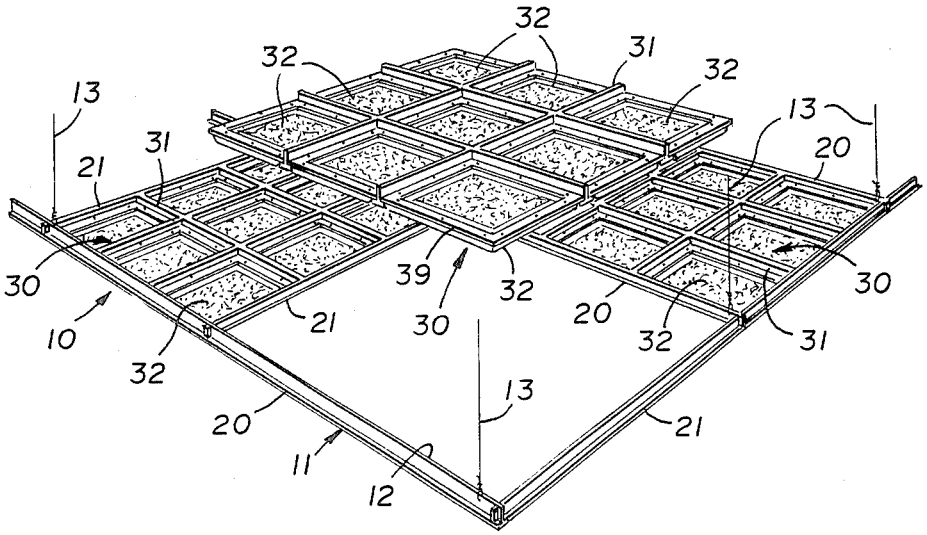
FIG. 1 is a top fragmentary, partially exploded perspective view of a subceiling construction embodying the principles of the invention.

By way of disclosing a preferred embodiment of the invention, not by way of limitation, there is shown in FIG. 1 a suspended ceiling 10 comprising a grid 11 of spaced, parallel, longitudinal main runners 20, spaced, parallel, lateral cross runners 21, and panel units 30. The main runners and cross runners, intersecting at intervals, are approximately perpendicular to each other so as to form a plurality of square grid openings 12. The grid 11 is suspended by hanger wires 13 which, at their lower ends, are attached to holes formed in the main runners 20 and cross runners 21, and at their upper ends are attached to suitable overhead building components such as joists. The main runners and cross runners have cross-sections in the shape of an inverted "T".

The panel units 30 are each assemblies of a subgrid 31 and nine decorative light-transmitting subpanels 32. The subgrid is a unitary piece of molded plastic in the configuration of a "tic-tac-toe" board. The subpanels are made of tinted acrylic plastic and are molded to simulate the appearance of a glass block face. As shown throughout the figures, the subpanels of this embodiment are molded in a "crushed ice" design. The subpanels 32 are generally square with a shallow depressed central portion bounded by a peripheral flanges 39. The subpanels 32 are fixed in the subgrid openings with their peripheral flanges resting on the subgrid. The panel units 30 rest in the grid openings 12 upon the grid main runners 20 and cross runners 21.

Figure 2:
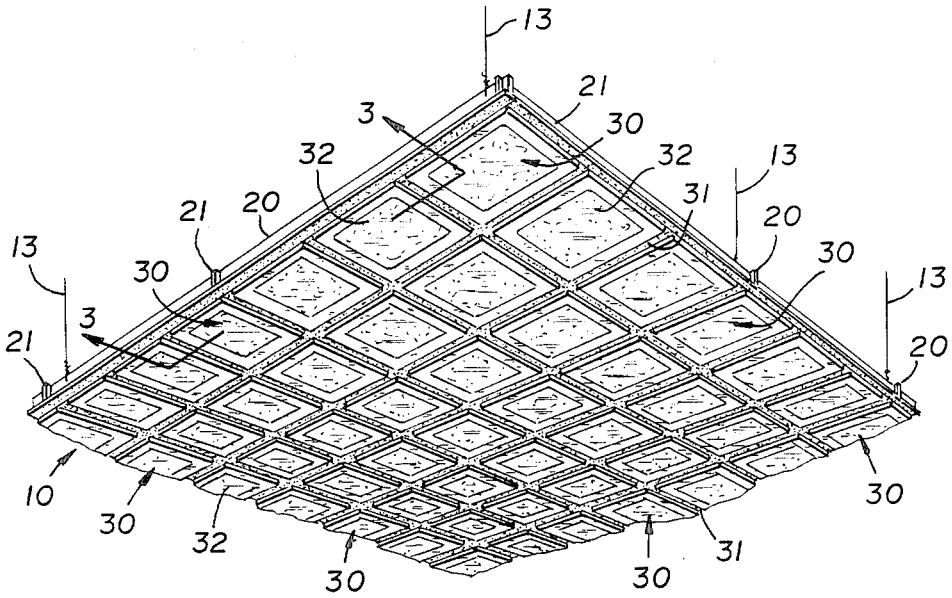
FIG. 2 is a bottom fragmentary perspective view of a subceiling similar to that shown in FIG. 1.

As best shown in FIG. 2, the underside of the assembled subceiling gives the appearance of a continuous expanse of glass block masonry. The simulated mortar lines presented by the undersides of the main runners 20, cross runners 21, and subgrids are substantially indistinguishable.

Figure 3:
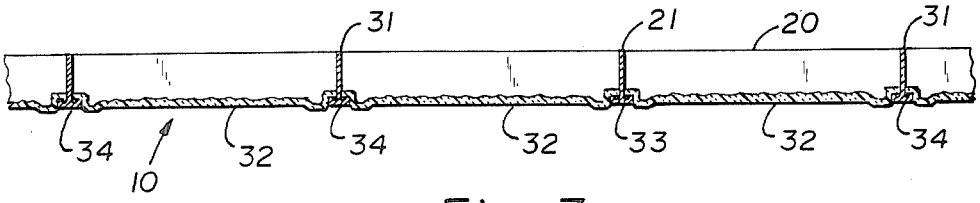
FIG. 3 is a fragmentary sectional elevational view taken along the line 3—3 of FIG. 2.

Referring to FIG. 3, it may be seen that the cross runners 21 and subgrids 31 are formed with similar cross-sections substantially in the shape of an inverted "T". The main runners 20 are configured in like manner. The subceiling construction 10 forms a substantially planar horizontal expanse with no readily visible interruption in the overall pattern of the underside of the ceiling. This effect is due in part to the cross runner and main runner cross members 33 being of the same width as the subgrid cross members 34. In addition, the undersides of the cross runners 21 and main runners 20 have a finish matching the color and texture of the underside of the subgrids 31. The finish match may be achieved by use of a suitable coating material.

Figure 4:
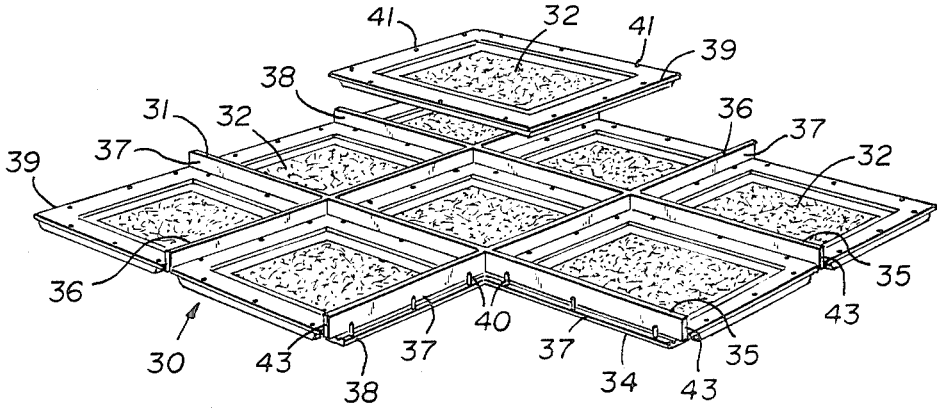
FIG. 4 is a top perspective, partially exploded view of a panel unit according to the invention.
Figure 5:
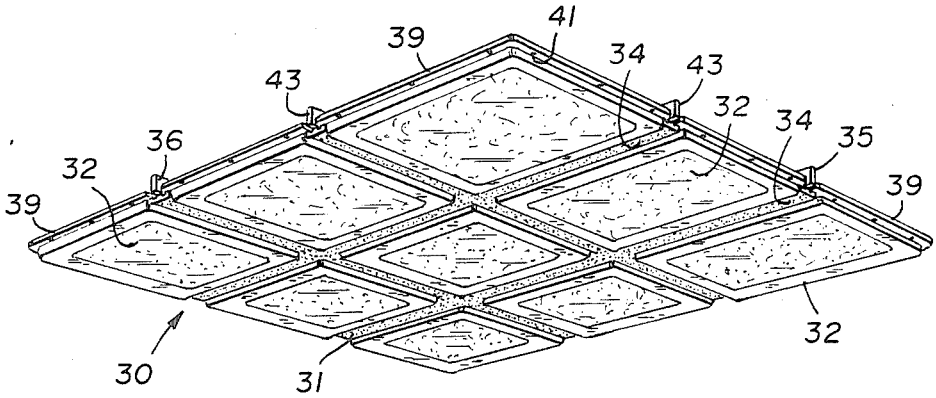
FIG. 5 is a bottom perspective view of an assembled panel unit similar to that shown in FIG. 4.

The construction of the panel units may be further described with reference to FIGS. 4 and 5. In this preferred embodiment, the subgrid 31 is formed of a unitary piece of opaque molded plastic. The subgrid comprises a "tic-tac-toe" arrangement of two spaced, parallel, longitudinal rails 35 and two spaced, parallel, lateral rails 36, each, as previously mentioned, having an inverted "T" cross-section. On either side of the intersections thereof, the rails 35 and cross rails 36 form twelve rail elements 37 of substantially equal length. Adjacent rail elements in combinations of two at the corners of panel unit, three at the sides, and four at the center form nine subgrid openings 38.

Each subpanel 32, formed of molded translucent acrylic plastic, is generally square in plan, corresponding in size and shape to the subgrid openings 38. Each subpanel is provided with a peripheral flange 39 adapted to rest atop the cross members 34 of the rails 35 and cross rails 36.

The subpanels 32 are fixed to the subgrid 31 by suitable means such as cement. Upwardly extending pins 40 are formed at spaced intervals along the upper surfaces of the subgrid cross members 34 adapted to mate with corresponding holes 41 formed through the flanges of the subpanels 32.

The outermost ends 43 of the subgrid rails and cross rails extend beyond the rail and cross rail cross members 34 by a distance approximately slightly less than half the width of the grid main runner and cross runner cross members 33 (FIG. 3). The rail and cross rail outer ends thus formed and the outermost portions of the subpanel flanges 39 together form a lip around the perimeter of the subpanel unit 30 adapted to rest atop the cross members 33 of the grid main runners 20 and cross runners 21.

It has been found that convenient nominal dimensions for the subceiling construction of the invention are two foot square grid openings, seven and one-half inch square subpanels, and one-half inch wide runner and rail cross members. However, the invention may also be practiced with other dimensions, shapes, and configurations such as rectangular grid openings or more or fewer that nine subpanels in each panel unit. For example, the subgrid may be formed with only one rail and one cross rail holding four subpanels.

It should be understood that other modifications and variations in the illustrative embodiment disclosed herein are possible with out departing from the scope of the following claims.

I claim:

1. A subceiling construction comprising:

a horizontally extending grid of spaced, longitudinal main runners and spaced, lateral cross runners transverse to said main runners forming a plurality of grid openings therebetween;

means for suspending said grid from overhead building components; and a plurality of panel units disposed in said grid openings resting about their perimeters upon said main runners and cross runners, each of said panels units comprising a unitary subgrid of at least one longitudinal rail and at lest one lateral rail intersecting thereacross forming a plurality of subgrid openings defined by adjacent segments of said longitudinal and lateral rails, and a plurality of decorative light-transmitting subpanels, said subpanels disposed in said subgrid openings resting about at least portions of their perimeters upon said adjacent longitudinal and lateral rails.

2. The subceiling construction of claim 1 wherein each of said subpanels is fixed to said subgrid.

3. The subceiling construction of claim 1 wherein said main runners, cross runners, and longitudinal and lateral rails, each are formed with a cross-section in the shape of an inverted "T" having a lower cross member.

4. The subceiling construction of claim 3 wherein each of said subpanels is formed with a peripheral flange adapted to rest upon the cross members of said longitudinal and lateral rails.

5. The subceiling construction of claim 4 wherein the outermost portions of said subpanel flanges and the outermost ends of said longitudinal and lateral rails form a panel unit peripheral lip adapted to rest upon the cross members of said main runners and cross runners.

6. The subceiling construction of claim 1 wherein said subpanels simulate the appearance of glass block faces and the undersides of said main runners, cross runners, and lateral and longitudinal rails simulate the appearance of mortar disposed between adjacent subpanels.

7. The subceiling construction of claim 1 wherein said longitudinal and lateral rails comprise a plurality of spaced, parallel, longitudinal rails and a plurality of spaced, parallel, lateral cross rails.

8. In a subceiling having a horizontally extending grid of spaced, longitudinal main runners and spaced, lateral cross runners, the combination therewith of a panel unit comprising:

a unitary subgrid of at least one longitudinal rail and at least one lateral rail intersecting thereacross forming a plurality of subgrid openings defined by adjacent segments of said longitudinal and lateral rails, and a plurality of decorative light-transmitting subpanels, said subpanels disposed in said subgrid openings resting about at least portions of their perimeters upon said adjacent longitudinal and lateral rails.

9. The combination of claim 8 wherein said longitudinal and lateral rails, said main runners and said cross runners are each formed with a cross-section in the shape of an inverted "T" having a lower cross member, and said subpanels are each formed with a peripheral flange adapted for resting upon the cross members of said longitudinal and lateral rails and said main runners and cross runners.

10. The combination of claim 9 wherein the outermost portions of said subpanel flanges and the outermost ends of said longitudinal and lateral rails form a panel unit peripheral lip adapted to rest upon the cross members of said main runners and cross runners.

11. The combination of claim 8 wherein said subpanels simulate the appearance of glass block faces and the undersides of said main runners, cross runners, and lateral and longitudinal rails simulate the appearance of mortar disposed between adjacent subpanels.

12. A panel unit adapted for installation in the openings of an architectural grid, said panel unit comprising:

a unitary subgrid of at least one longitudinal rail and at least one lateral rail intersecting thereacross forming a plurality of subgrid openings defined by adjacent segments of said longitudinal and lateral rails, and a plurality of decorative light-transmitting subpanels, said subpanels disposed in said subgrid openings resting about at least portions of their perimeters upon said adjacent longitudinal and lateral rails.

13. The panel unit of claim 12 wherein each of said subpanels is fixed to said subgrid.

14. The panel unit of claim 12 wherein said longitudinal and lateral rails are each formed with a cross-section in the shape of an inverted "T" having a lower cross member, and wherein each of said subpanels is formed with a peripheral flange adapted to rest upon the cross members of adjacent longitudinal and lateral rails.

15. The panel unit of claim 12 wherein said subpanels simulate the appearance glass block faces and the undersides of said lateral and longitudinal rails simulate the appearance of mortar disposed between adjacent subpanels.

16. The panel unit of claim 12 wherein said longitudinal and lateral rails comprise a plurality of spaced, parallel, longitudinal rails and a plurality of spaced, parallel, lateral cross rails.

17. The panel unit of claim 12 wherein the outermost portions of said subpanel flanges and the outermost ends of said longitudinal and lateral rails for a panel unit peripheral lip adapted to rest on the architectural grid.

* * * * *

UNITED STATES PATENT AND TRADEMARK OFFICE

CERTIFICATE OF CORRECTION

PATENT NO. : 4,702,056

DATED : October 27, 1987

INVENTOR(S) : Bruce P. Carey

It is certified that error appears in the above—identified patent and that said Letters Patent is hereby corrected as shown below:

Column 3, line 68, change "fewer that nine" to -- fewer than nine --;

Column 2, line 27, change "skilled those" to -- skilled --;

Column 3, line 1, change "flanges" to -- flange --;

Column 4, line 20, change "lest" to -- least --.

Signed and Sealed this

First Day of March, 1988

*Attest:*

*Attesting Officer*

DONALD J. QUIGG

*Commissioner of Patents and Trademarks*